US010405673B1

(12) United States Patent
Ondrasik

(10) Patent No.: US 10,405,673 B1
(45) Date of Patent: Sep. 10, 2019

(54) SHELVING RACK HAVING BOTTOM SUPPORT PANEL WITH MOVEABLE DIVIDERS

(71) Applicant: THE ONDRASIK FAMILY TRUST DATED 11/3/1999, Commerce, CA (US)

(72) Inventor: V. John Ondrasik, Commerce, CA (US)

(73) Assignee: THE ONDRASIK FAMILY TRUST DATED 11/3/1999, Commerce, CA (US)

( * ) Notice: Subject to any disclaimer, the term of this patent is extended or adjusted under 35 U.S.C. 154(b) by 0 days.

(21) Appl. No.: 15/979,233

(22) Filed: May 14, 2018

(51) Int. Cl.

| | |
|---|---|
| ***A47F 1/12*** | (2006.01) |
| ***A47F 5/00*** | (2006.01) |
| ***A47F 7/28*** | (2006.01) |
| ***A47F 3/04*** | (2006.01) |

(52) U.S. Cl.
CPC ..... *A47F 1/121* (2013.01); *A47F 3/0426* (2013.01); *A47F 5/0056* (2013.01); *A47F 7/28* (2013.01); *A47F 5/005* (2013.01)

(58) Field of Classification Search
CPC ..... A47F 5/0068; A47F 5/0056; A47F 5/005; A47F 1/121; A47F 7/28; A47F 3/0426; A47B 65/15
USPC ..... 108/60, 61; 206/561; 312/35; 211/184; D6/706
See application file for complete search history.

(56) References Cited

U.S. PATENT DOCUMENTS

| | | | | | |
|---|---|---|---|---|---|
| 936,725 | A * | 10/1909 | Insinger | A47L 19/04 | 211/126.2 |
| 1,277,827 | A * | 9/1918 | Barber | A47C 29/006 | 135/137 |
| 2,933,195 | A * | 4/1960 | Radek | A47B 57/58 | 211/153 |
| 3,149,729 | A * | 9/1964 | Smith | A47F 5/01 | 211/126.9 |
| 3,194,528 | A * | 7/1965 | Chesley | A47B 96/028 | 108/108 |
| 3,255,987 | A * | 6/1966 | Gatch | F16B 21/02 | 108/156 |
| 3,269,547 | A * | 8/1966 | Chamberlin | A47B 57/58 | 108/60 |
| 3,301,408 | A * | 1/1967 | Craine | A47B 57/586 | 211/184 |
| 3,385,451 | A * | 5/1968 | Anderson | A47F 7/0021 | 211/184 |
| 3,497,081 | A * | 2/1970 | Field | A47B 57/58 | 211/184 |
| 3,501,019 | A * | 3/1970 | Armstrong | A47B 57/58 | 108/61 |
| 3,501,020 | A * | 3/1970 | Krikorian | A47F 5/005 | 211/184 |

(Continued)

*Primary Examiner* — Jonathan Liu
*Assistant Examiner* — Devin K Barnett
(74) *Attorney, Agent, or Firm* — Gordon Rees Scully Mansukhani LLP; David R. Heckadon

(57) ABSTRACT

A shelving rack system, having at least two divider supports extending across the bottom of a base, with a support panel positioned on top of the base, wherein the dividers are positionable from side-to-side to vary the width of the product dispensing channels between the dividers in the shelving rack. Each divider has legs that pass through holes in both the support panel and the divider supports.

10 Claims, 5 Drawing Sheets

(56) References Cited

U.S. PATENT DOCUMENTS 3,559,815 A * 2/1971 Huddleston ..... A47F 5/005 211/184
3,601,258 A * 8/1971 Stein ..... A47B 57/586 211/184
3,608,741 A * 9/1971 Schray ..... A47F 5/005 211/184
3,750,894 A * 8/1973 Jensen ..... A47F 5/005 211/184
3,767,057 A * 10/1973 Holmes ..... B42F 17/08 206/561
3,784,027 A * 1/1974 Gold ..... A47F 5/0823 108/60
3,827,574 A * 8/1974 Craig, Sr. ..... A47F 5/005 211/184
4,190,167 A * 2/1980 Wells ..... A47F 5/005 108/61
4,191,299 A * 3/1980 Moore ..... A47F 5/005 108/61
RE30,706 E * 8/1981 Bustos ..... A47F 1/12 193/2 D
4,346,806 A * 8/1982 Bustos ..... A47F 7/28 108/61
4,437,572 A * 3/1984 Hoffman ..... A47F 5/13 108/60
4,461,388 A * 7/1984 Bustos ..... A47F 7/28 211/184
4,589,349 A * 5/1986 Gebhardt ..... A47B 96/025 108/102
4,750,625 A * 6/1988 Frederick ..... A47B 96/02 108/157.13
4,872,567 A * 10/1989 Bustos ..... A47B 57/42 211/59.2
5,074,420 A * 12/1991 Cappel, III ..... A47B 65/00 211/181.1
5,119,945 A * 6/1992 Wiggins ..... A47F 5/0056 211/184
5,205,421 A * 4/1993 Bustos ..... A47F 5/005 108/108
5,437,380 A * 8/1995 Peay ..... A47F 5/0056 108/61
5,464,105 A * 11/1995 Mandeltort ..... A47F 5/005 108/61
5,490,600 A * 2/1996 Bustos ..... A47B 57/00 211/184
D375,860 S * 11/1996 Coretti, Jr. ..... D6/566
5,607,068 A * 3/1997 Coretti, Jr. ..... A47F 5/135 211/59.2
6,116,436 A * 9/2000 Ferrucci ..... A47B 55/02 108/181
6,244,447 B1 * 6/2001 Frieze ..... A61L 2/07 206/370
6,299,004 B1 * 10/2001 Thalenfeld ..... A47F 1/12 211/184
6,302,036 B1 10/2001 Carson et al.
6,354,446 B1 * 3/2002 Chang ..... A47B 65/00 211/184
6,389,993 B1 5/2002 Ondrasik
6,401,942 B1 * 6/2002 Eckert ..... A47F 1/126 211/184
6,526,897 B1 3/2003 Ondrasik
6,688,240 B2 2/2004 Ondrasik
6,793,223 B2 9/2004 Ondrasik et al.
6,805,250 B2 10/2004 Ondrasik
7,168,711 B2 1/2007 Ondrasik
7,601,312 B2 * 10/2009 Riley ..... A61B 50/33 248/309.1
7,815,060 B2 * 10/2010 Iellimo ..... B65G 1/023 108/61
7,896,171 B2 * 3/2011 Battaglia ..... A47F 5/0056 211/106
7,950,537 B1 * 5/2011 Goodman ..... A47B 57/581 211/184
8,501,259 B2 * 8/2013 Vergara ..... A23B 4/062 206/557
8,579,121 B2 * 11/2013 Eng ..... A47L 15/505 211/184
9,260,126 B2 2/2016 Ondrasik
9,351,590 B1 * 5/2016 Wildrick ..... A47F 5/0056
9,721,317 B2 * 8/2017 Alletto, Jr. ..... G06Q 90/00
2001/0047968 A1 * 12/2001 Wright ..... A47L 19/04 211/41.3
2003/0178384 A1 * 9/2003 Speed ..... A47F 5/0068 211/119.003
2004/0011754 A1 * 1/2004 Zadak ..... A47B 57/58 211/184
2004/0099619 A1 * 5/2004 Bustos ..... A47F 5/0056 211/59.2
2004/0256341 A1 * 12/2004 Donnell ..... A47F 1/12 211/187
2005/0139560 A1 * 6/2005 Whiteside ..... A47B 57/586 211/119.003
2005/0161418 A1 * 7/2005 Lynch ..... A47F 5/0056 211/119.003
2006/0113262 A1 * 6/2006 Knorring, Jr. ..... A47F 1/121 211/59.2
2010/0206829 A1 * 8/2010 Clements ..... A47F 1/12 211/162
2010/0219147 A1 * 9/2010 Moody ..... F25D 25/022 211/181.1
2012/0305508 A1 * 12/2012 Brozak ..... A47F 5/0056 211/85.5
2013/0020270 A1 * 1/2013 Valiulis ..... A47F 5/005 211/59.2
2013/0306583 A1 * 11/2013 Caldwell ..... A47B 57/581 211/181.1
2014/0103594 A1 * 4/2014 Drummond ..... A47J 47/005 269/134
2015/0023727 A1 * 1/2015 Williams ..... A47F 5/0031 403/188
2015/0196138 A1 * 7/2015 Juric ..... A47F 1/126 211/59.3
2015/0196165 A1 * 7/2015 Iee ..... A47J 47/005 269/293
2018/0352975 A1 * 12/2018 Alletto ..... A47F 5/0056

* cited by examiner

SHELVING RACK HAVING BOTTOM SUPPORT PANEL WITH MOVEABLE DIVIDERS

TECHNICAL FIELD

The present system relates in general to wire shelving units and in particular to wire shelving units for dispensing products such as milk and beverages from refrigerated store cabinets.

SUMMARY OF THE INVENTION

The present system provides a shelving rack system, comprising: a wireframe base; at least two divider supports extending across the bottom of the wireframe base; a support panel positioned on top of the wireframe base; and a plurality of dividers positioned on top of the support panel, wherein each divider has at least two legs, and each leg passes through a hole in the support panel and down into a hole in one of the divider supports.

The divider supports extend underneath the bottom of the wireframe base from one side of the wireframe base to the other, and the dividers extend from the back to the front of the shelving rack (above the wireframe base). Thus, the divider supports and the dividers are generally perpendicular to one another. This allows the dividers to be supported perpendicularly at many places along their lengths.

The holes in the support panel are positioned above the holes in the divider supports. Placing the legs of the dividers through the holes in the support panel and into the holes in the divider supports holds the dividers in position above the support panel. In addition, placing the legs of the dividers through the holes in the support panel also secures the support panel in position under the products being dispensed. An advantage of the present system is that the dividers are easily moveable side-to-side such that the side-to-side spacing between parallel dividers is adjustable. As such, the dividers can be positioned at various distances apart from one another that correspond to the widths of the products being dispensed. For example, the dividers can be positioned closer together when narrow cans of soda are positioned thereon, or farther apart when wider gallon jugs of milk are to be dispensed.

One advantage of the present shelving rack is the fact that the spacing between the dividers is quickly and easily adjustable. This is due to the fact that there are more sets of aligned holes in the support panel and divider supports than there are dividers being used. As such, the dividers can easily be moved from one position to another.

Another advantage of the present system is that the flat support panel underneath the products being dispensed reduces the total number of wires required in the wire frame below the support panel. This is due to the fact that the products being dispensed are supported by the flat support panel, rather than simply resting on a wire grid. As such, the wires of the wire grid (i.e. wire base) can be positioned farther apart from one another.

Optionally, the present system also includes a back support (such as a wire) spanning across the back ends of the dividers, and optional bottom legs for positioning the support rack in a cabinet. These and other mechanisms for attaching the present system to a cabinet are all contemplated, all keeping within the scope of the present invention.

DETAILED DESCRIPTION OF THE DRAWING

Figure 1:
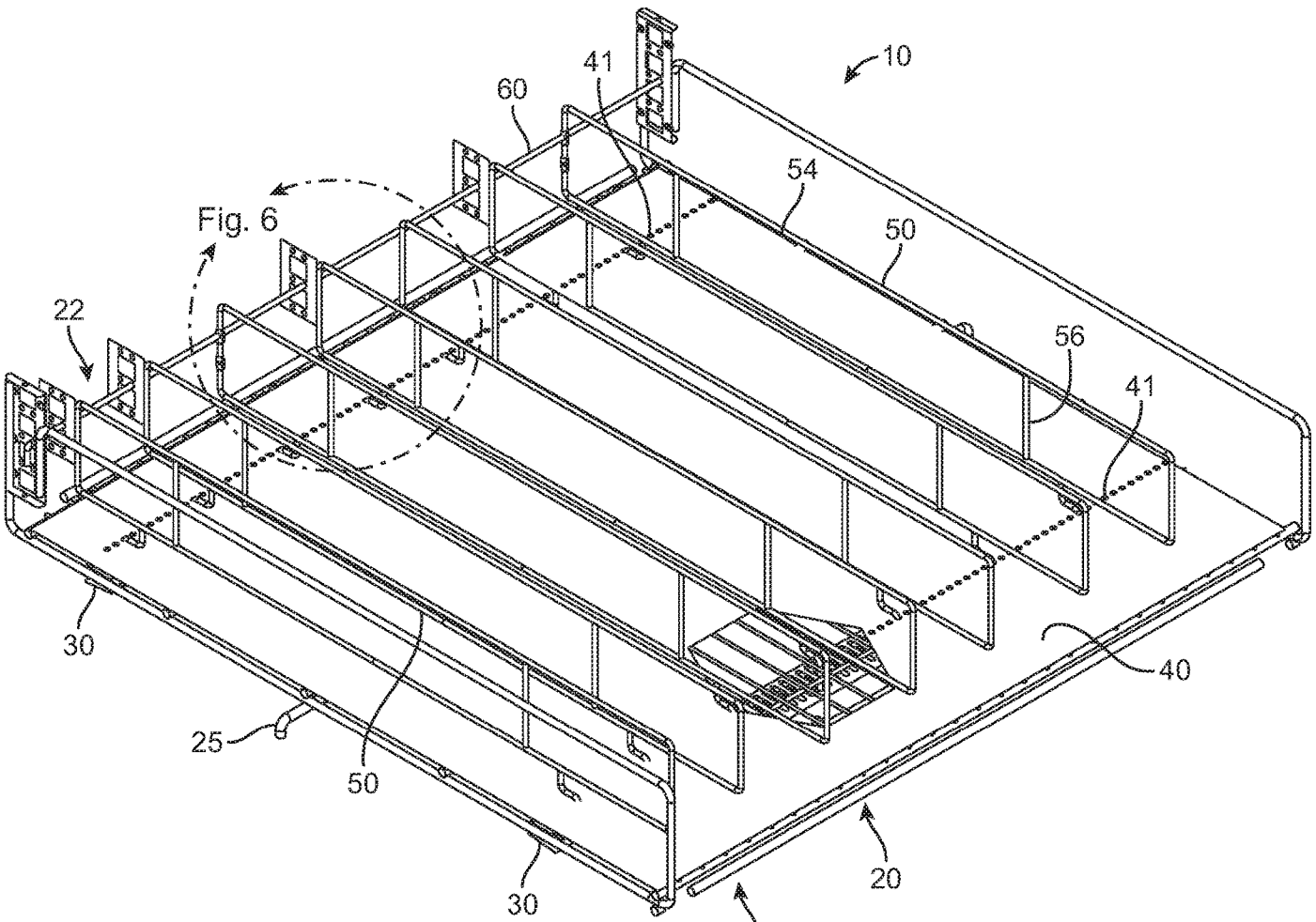
FIG. 1 is a rear perspective view of the present shelving rack system.
Figure 2:
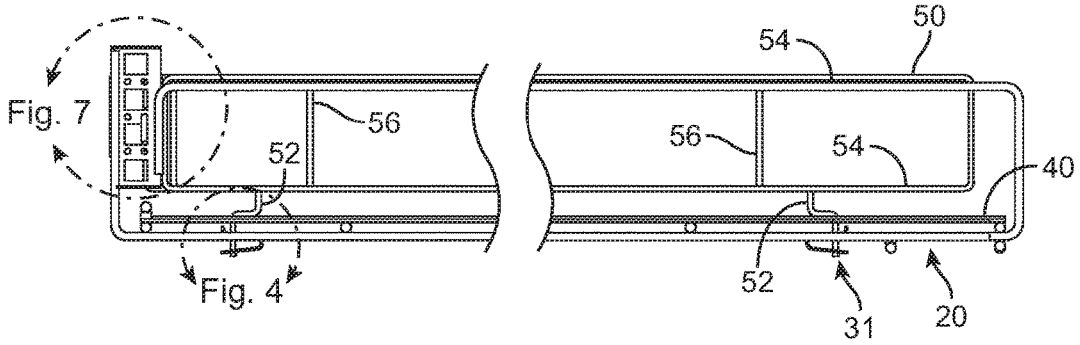
FIG. 2 is a side elevation view of the present shelving rack system.
Figure 3:
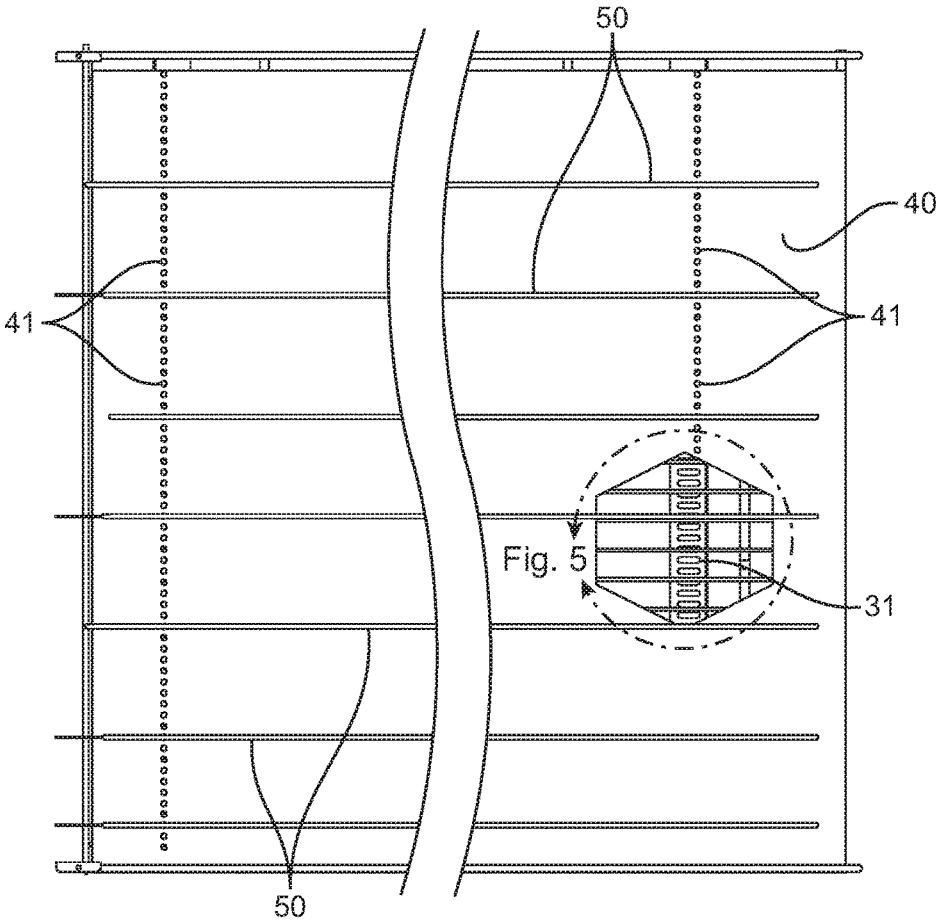
FIG. 3 is a top plan view of the present shelving rack system.

The present shelving rack system is seen in FIGS. 1 to 3, as follows.

Shelving system 10 comprises: a wireframe base 20; at least two divider supports 30 extending across the bottom of wireframe base 20; a support panel 40 positioned on top of wireframe base 20; and a plurality of dividers 50 positioned on top of support panel 40, wherein each divider 50 has at least two legs 52, and each leg 52 passes through a hole 41 in support panel 40 and also passes down into a hole 31 in one of divider supports 30. In optional embodiments of the present system, support panel 40 is omitted, and product can be placed directly upon wireframe base 20. In further optional embodiments, base 20 is not made of wireframe materials, but is instead made of other suitable materials. As such, the present system is not limited only to wireframe embodiments. As can also be seen, dividers 50 preferably extend from the back 21 to the front 22 of wireframe base 20. Optionally, wireframe base 20 can comprise bottom legs 25 for positioning the support rack in a cabinet.

Figure 8:
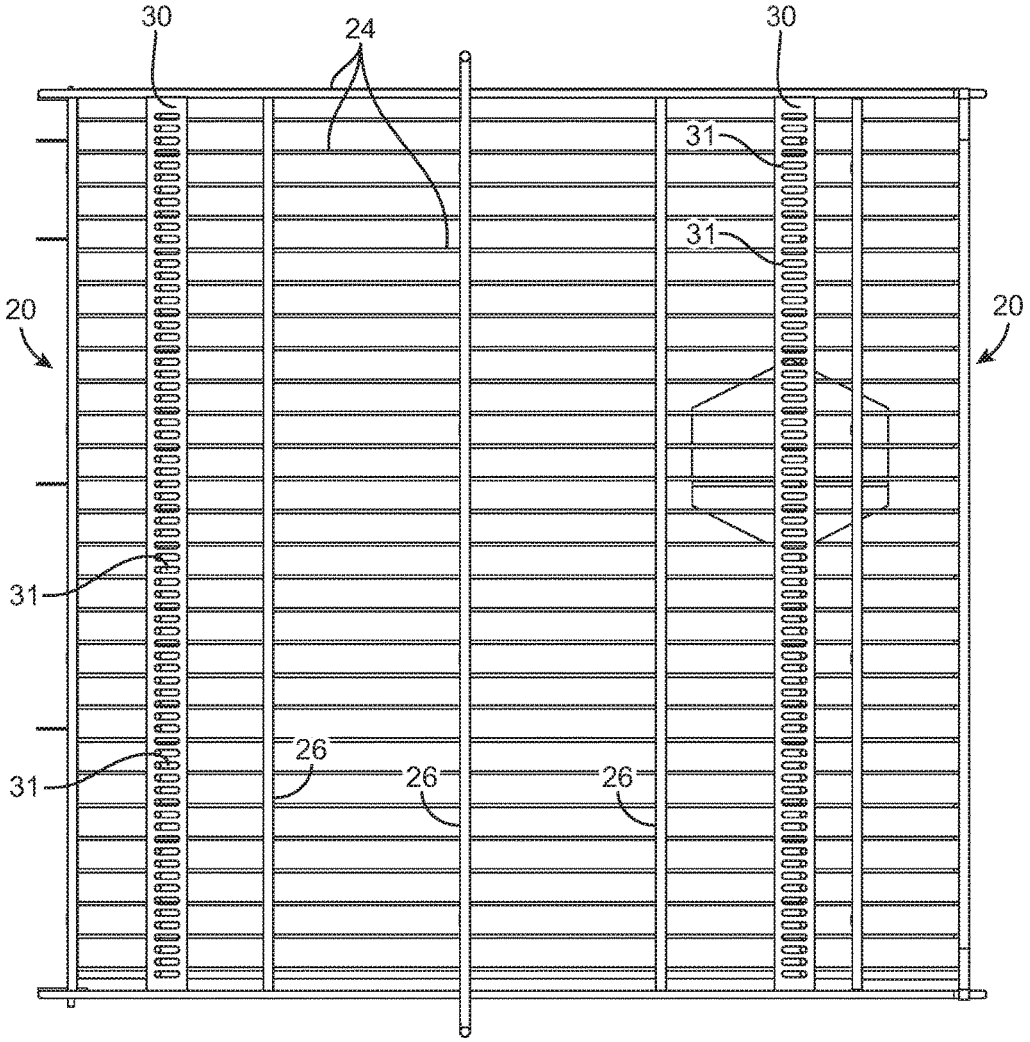
FIG. 8 is a bottom plan view of the present shelving rack system.

Preferably, as best seen in FIG. 8, wireframe base 20 comprises both: parallel wireframe bars 24 extending from the back to the front of the wireframe base; and parallel wireframe bars 26 extending from one side of the wireframe base to the other side of the wireframe base.

Figure 4:
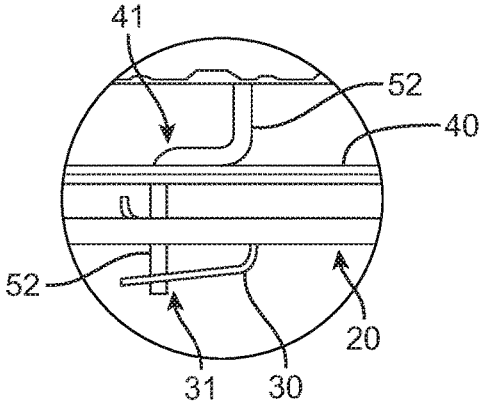
FIG. 4 is a close-up detail view of the leg of the divider passing through the holes in the support panel and through the holes in the divider supports.

As seen in the close-up view of FIG. 4, divider supports 30 are positioned below the bottom of wireframe base 20, and holes 41 in support panel 40 are positioned above the holes 31 in the divider supports. As such, legs 52 lock the support panel 40 into a secure position on top of wireframe base 20.

Figure 5:
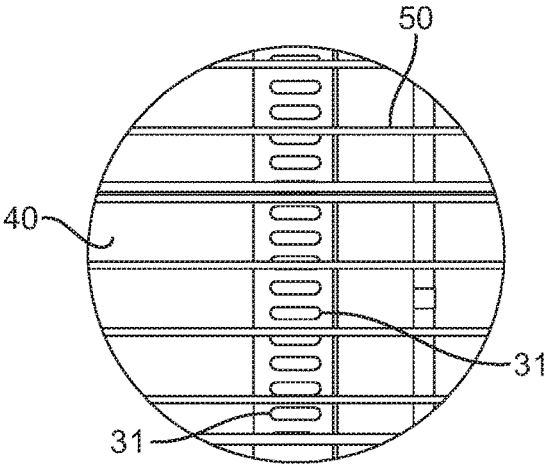
FIG. 5 is a close-up top plan view corresponding to FIG. 1, with a section of the support panel removed, showing the wire frame structure therebelow.

As seen in the close-up view of FIG. 5, divider supports 30 extend from one side of wireframe base 20 to the other side of wireframe base 20. Thus, dividers 50 extend in a perpendicular direction to divider supports 30. Preferably, as best seen in FIG. 2, each divider 50 comprises parallel horizontal bars 54 and optional parallel vertical bars 56 to strengthen the dividers 50 vertically.

As can be appreciated, dividers 50 are individually positionable between a plurality of different parallel side-to-side positions such that the side-to-side spacing between parallel dividers can be adjusted as desired. This re-positioning of individual dividers 50 is done by simply moving legs 51 from one hole 31 to another hole 31 in divider supports 30.

Preferably, the parallel wireframe bars 24 extending from the back to the front of the wireframe base 20 are spaced farther apart than the spacing between dividers 50.

Figure 6:
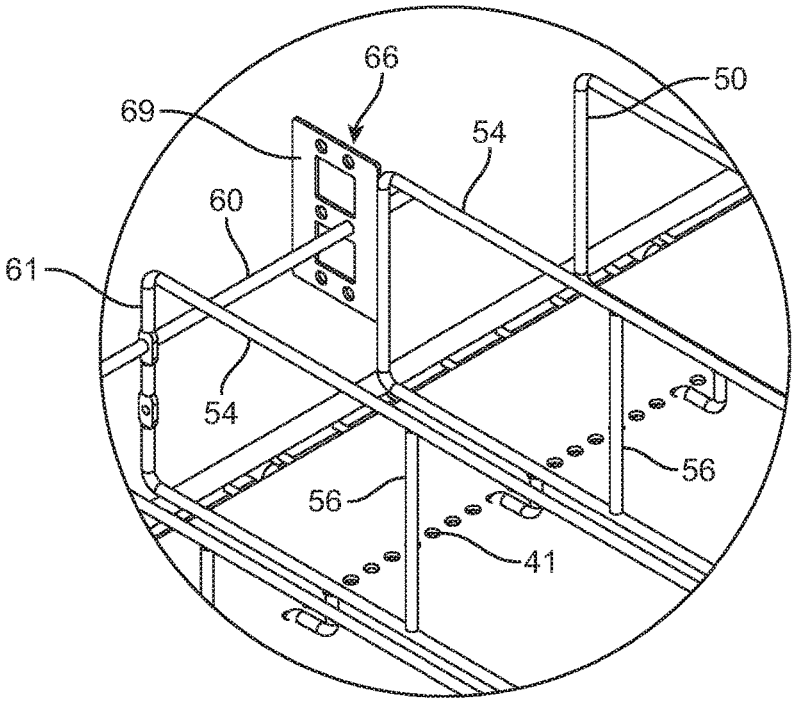
FIG. 6 is a close-up of an optional divider that accepts thick and thin front stops.
Figure 7:
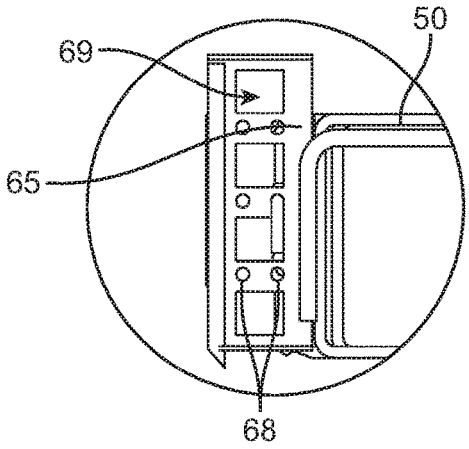
FIG. 7 is a close-up of an optional front bracket attached to the present shelving rack system.

As seen in FIGS. 6 and 7, an optional front stops 60 spans across the front ends of dividers 50. As can be seen, the optional front stop can simply be a wire that passes through divider 50 (at point 61), or a wire that passes through an optional front bracket 65 (at point 66). As seen in FIG. 7, front bracket 65 can optionally have small holes 68 for passing a slender wire therethrough, or larger holes 69 for passing a bar therethrough. Moreover, these various round and square apertures can be positioned at different heights, as illustrated.

What is claimed is:

1. A shelving rack system, comprising:

a wireframe base, wherein the wireframe base comprises a length, a width, a plurality of first parallel bars extending from a back to a front along the length of the wireframe base, and a plurality of second parallel bars extending from a left side to a right side of the wireframe base along the width of the wireframe base, wherein the second parallel bars are perpendicular relative to the first parallel bars;

a continuous planar support panel positioned on top of the wireframe base, wherein the support panel substantially covers the wireframe base, wherein the support panel comprises a plurality of holes therein;

at least two divider support strips attached to a bottom of the wireframe base and extending substantially the entire width of the wireframe base, wherein each divider support strip is below the wireframe base and each divider support strip has a plurality of apertures therein, wherein each divider support strip is spaced apart from each other;

a plurality of dividers positioned on top of the support panel, wherein each divider has at least two legs, and each leg passes both through a corresponding hole from said holes in the support panel and through a corresponding aligned aperture from said apertures in one of the divider support strips from said at least two divider support strips such that the divider legs lock the support panel into a secure position on top of the wireframe base; and wherein the number of divider legs is less than the number of apertures in each divider support strip.

2. The shelving rack system of claim 1, wherein the holes in the support panel are positioned above the apertures in the divider support strips.

3. The shelving rack system of claim 1, wherein the dividers extend in a direction generally parallel to the first parallel bars of the wireframe base.

4. The shelving rack system of claim 1, wherein the dividers extend in a perpendicular direction to the divider support strips.

5. The shelving rack system of claim 1, wherein the dividers are parallel to each other.

6. The shelving rack system of claim 1, wherein the dividers are each individually positionable between a plurality of parallel positions such that a spacing between a corresponding pair of adjacent dividers from said plurality of dividers is adjustable.

7. The shelving rack system of claim 1, further comprising: a front stop spanning across front ends of the dividers.

8. The shelving rack system of claim 7, wherein the front stop is a wire that passes through front brackets of corresponding dividers from said dividers respectively.

9. The shelving rack system of claim 1, further comprising: a front stop passing between adjacent dividers from said plurality of dividers.

10. The shelving rack system of claim 8, wherein each front bracket has openings therein for the front stop to pass therethrough.

* * * * *